US005788350A

United States Patent [19]

Fladung

[11] Patent Number: 5,788,350

[45] Date of Patent: Aug. 4, 1998

[54] PORTABLE SYSTEM FOR A BASEPLATE ADAPTED FOR USE WITH CONNECTABLE BUILDING COMPONENTS

[76] Inventor: Daniel Edwin Fladung, 13054 Taylorcrest, Houston, Tex. 77079-6117

[21] Appl. No.: 790,718

[22] Filed: Jan. 31, 1997

[51] Int. Cl.[6] ..... E06B 1/00

[52] U.S. Cl. ..... 312/321.5; 312/311; 312/244; 446/75; 446/128

[58] Field of Search ..... 446/71, 75, 128; 312/321.5, 326, 327, 328, 329, 244, 311, 270.3

[56] References Cited

U.S. PATENT DOCUMENTS

| | | | |
|---|---|---|---|
| 2,215,881 | 9/1940 | Levensten | 312/311 |
| 2,573,014 | 10/1951 | Haddrell | 312/321.5 X |
| 3,271,092 | 9/1966 | Hatfield et al. | 312/311 |
| 4,118,086 | 10/1978 | Kneier | 312/311 |
| 4,448,463 | 5/1984 | Amos | 312/321.5 X |
| 4,480,744 | 11/1984 | Blackmon | 312/321.5 X |
| 4,591,215 | 5/1986 | Robbins | 312/234 X |
| 4,729,474 | 3/1988 | Lanius et al. | 312/244 X |
| 4,861,305 | 8/1989 | Wilson | 446/75 |
| 4,872,410 | 10/1989 | Lilly | 446/128 X |
| 5,250,000 | 10/1993 | Boutin et al. | 446/128 X |
| 5,269,599 | 12/1993 | Moring | 312/321.5 X |
| 5,603,558 | 2/1997 | Zimmer | 312/311 X |
| 5,615,619 | 4/1997 | King | 446/75 X |
| 5,643,038 | 7/1997 | Olsen et al. | 446/128 X |

OTHER PUBLICATIONS

Catalog entitled "World of Adventures!" Lego Group, Jan. 1977.

advertisement page entitled Mega Bloks and Mega "Wee" Bloks Ritvik Group, Inc. Dec. 1992.

One page instruction sheet entitled Zag Ltd. of Israel. (No date given).

Photograph having Exhibit No. 1 showing a plastic structure having 10 shelves Contico Manufacturing Company. (No date given).

Photographs having Exhibit Nos. 2 and 3 disclose a red plastic case with a handle having a hinged door Dec. 1985 The Lego Group, Lego Systems, Inc. of Enfield, CT.

Photographs having Exhibit Nos. 4 and 5 disclose a plastic structure having 6 shelves Zag Ltd. of Israel. (No date given).

Publication entitled "Extra Extra 44 New Items Lego Shop at Home Service" pp. 10, 11, 12, Lego Group, Dec. 1988.

*Primary Examiner*—Peter M. Cuomo
*Assistant Examiner*—James O. Hansen
*Attorney, Agent, or Firm*—Pravel, Hewitt, Kimball & Krieger

[57] ABSTRACT

A system, adapted for use with connectable building components used to build a unit, includes a structure having an open area accessible from the front of the structure for storing the unit. A baseplate is moveable between a storage position for controlled movement of the baseplate in the open area and an extended position adapted for building the unit from the connectable building components. The baseplate includes either a plurality of upwardly extending members, openings or other connectors for connecting the unit to the baseplate. Guide rails block upward movement of the baseplate and the closure when moved in the closed position blocks movement of the baseplate out of the structure. The system further includes a plurality of drawers having compartments positioned in the structure movable between a retracted position adapted for storing and transporting the connectable building components and an extended position for access to the connectable building component.

19 Claims, 3 Drawing Sheets

20
16G
32A
26D
26B
10
24D
24B
26A
16
26C
24C
24A
U
16A
16F
16C
4
4
16B
14
36B
28C'
28B
16E
18
30B
28
12
28A
16B'

20
16G
32A
10
16
22D
22B
28
22C
22A
16F
18
U
3
28C
U'
U'''
U''
36B
16B'
12
28C'
3

16C
14
16B'
36B
12A
12

FIG. 4
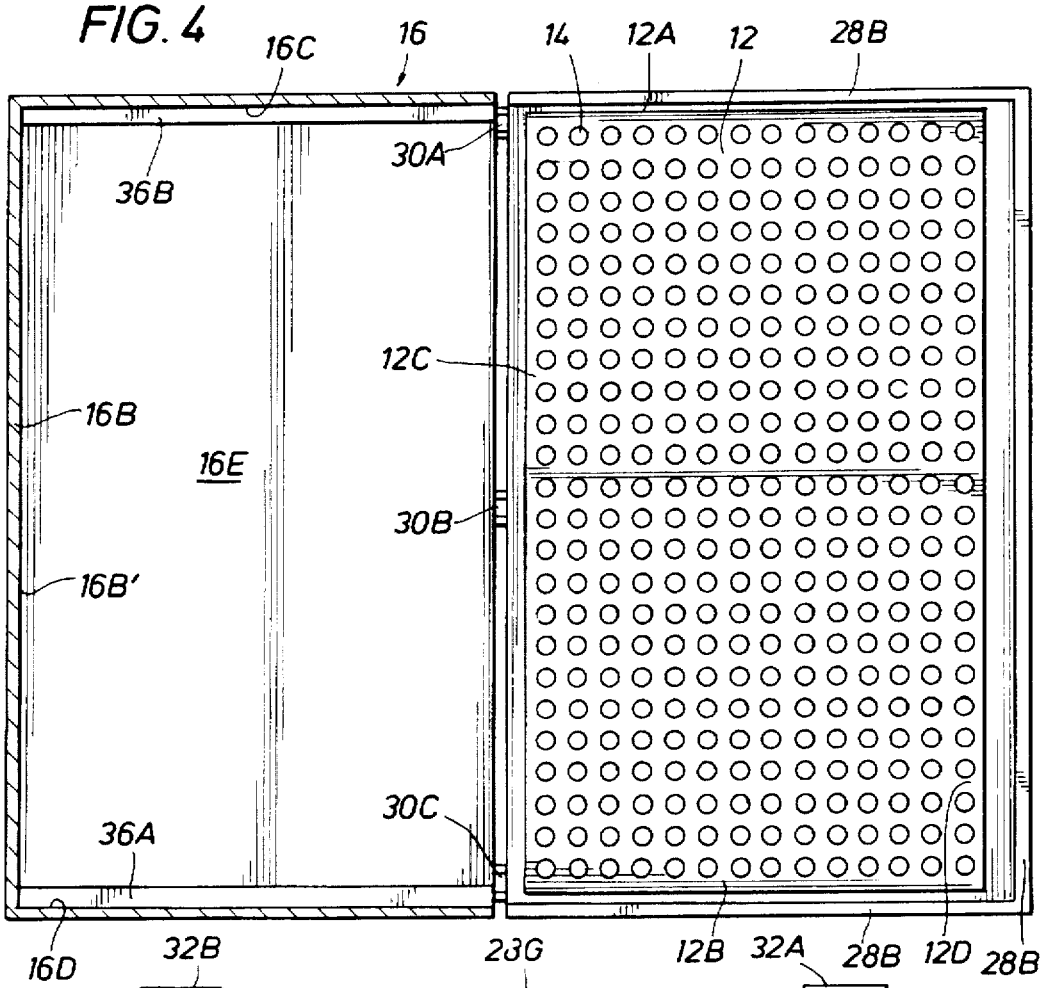
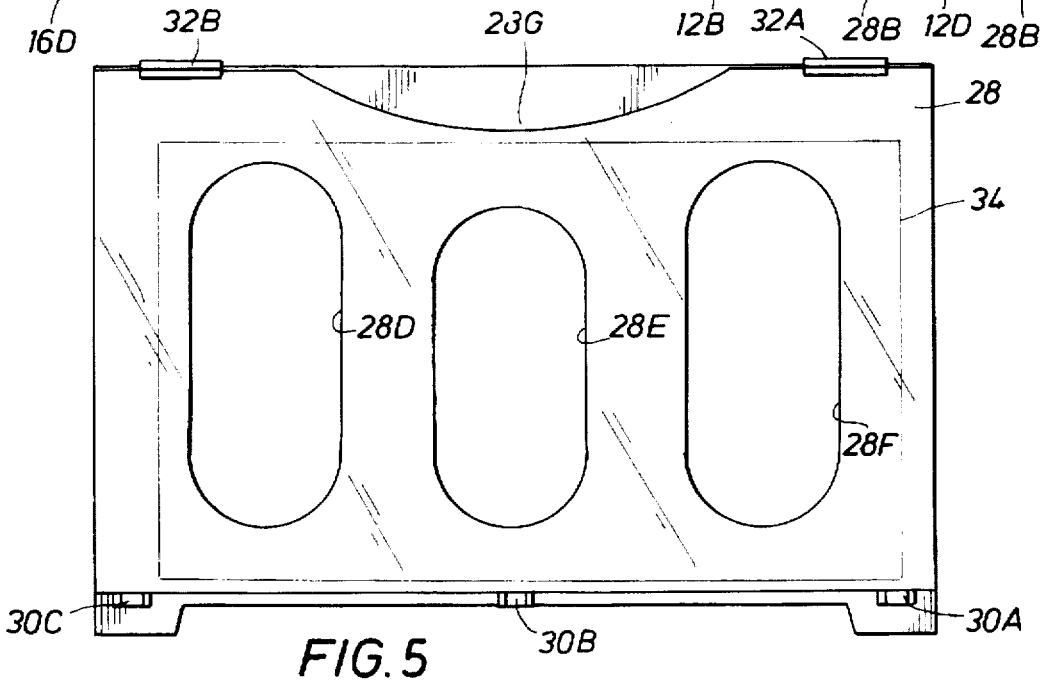
FIG. 5

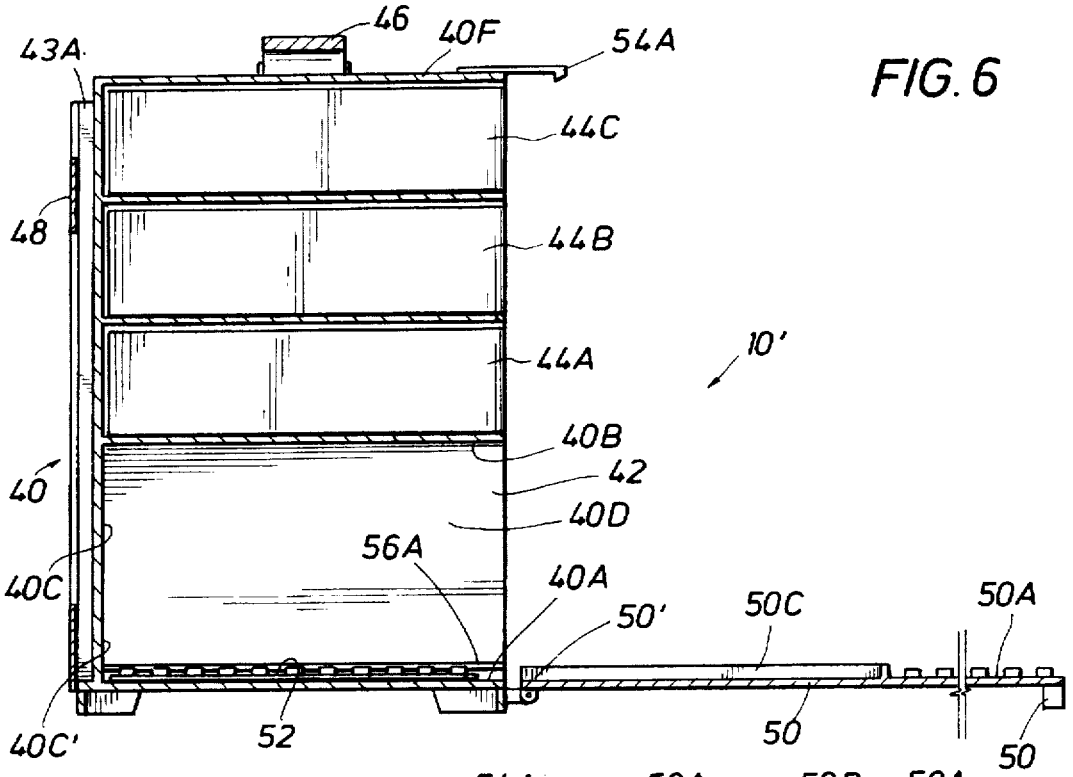
FIG. 6
FIG. 7
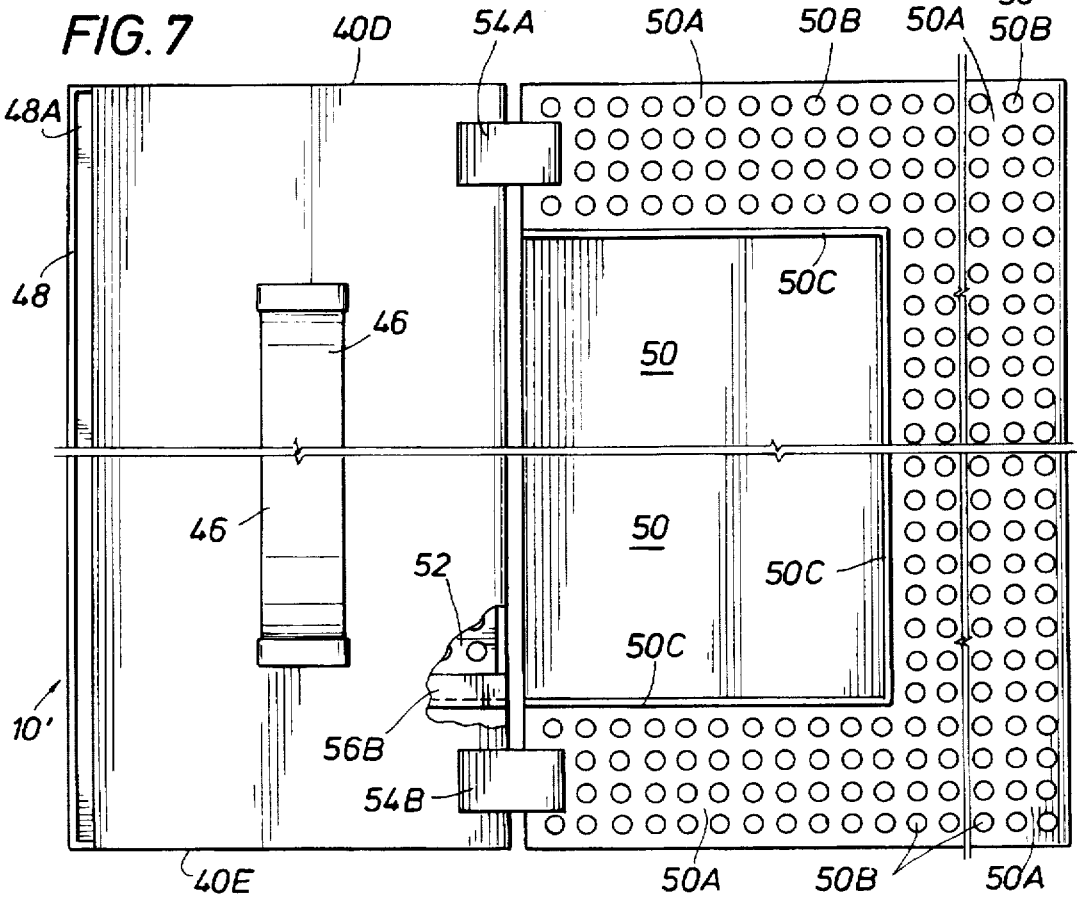

PORTABLE SYSTEM FOR A BASEPLATE ADAPTED FOR USE WITH CONNECTABLE BUILDING COMPONENTS

FIELD OF THE INVENTION

The present invention relates to a portable system for a baseplate adapted for use with connectable building components. In particular, the present invention relates to a transportable system for a baseplate having connectors adapted for use with connectable building components and storage compartments for the connectable building components and its method of use.

BACKGROUND OF THE INVENTION

Building systems have been known in the past using a baseplate having connectors to provide the foundation for building units from connectable building components. For example, both Lego Systems, Inc. of Enfield, Connecticut and Ritvik Toys Ltd. of the United Kingdom sell building systems having a baseplate with upwardly extending cylindrical connectors adapted for use with connectable building components or interlocking pieces. Also, Irwin Toy of Niagara Falls, N.Y. sells a "Girder and Panel" building system having a baseplate with a plurality of spaced apart female connectors or openings for receiving a girder having a downwardly extending male connector or member sized to be received in the opening. It is to be understood that when referring to connectors for these baseplates, that connectors include upwardly projecting or extending members of all shapes and sizes including cubes, triangular shaped projections, oblong shaped projections, cylinders and other shapes; openings; mechanical connectors such as snaps, nut and bolt; hook and pile connectors, such as the hook and pile fastener distributed under the trademark "VELCRO"; and any other type connectable and disengageable members of any shape, material or configuration.

There has also been known in the past containers for storing connectable building components or interlocking pieces. For example, Ritvik Toys Ltd. of the United Kingdom provides a number of containers for connectable building components having a removable top lid. One container has a removable lid having a plurality of upwardly extending cylindrical connectors. A handle disposed on the Ritvik container is movable between a downwardly holding position to hold the lid to the container and an upwardly extended position so the lid can be removed from the container.

Ritvik Toys Ltd. also sells a portable desk with retractable legs. The top of the desk has an exterior surface with a plurality of baseplates, each of the baseplates includes a plurality of upwardly extending cylindrical connectors. The side of the desk includes a handle for transporting the desk and the top of the desk opens to a compartment inside the desk for storing the connectable building components. Lego Systems, Inc. also sells a playtable having inwardly foldable legs and a handle in the top surface of the table. Two baseplates, having a plurality of upwardly extending cylindrical connectors, are slidably positioned on the table top surface to move between a closed position to cover the open storage area in the table and a central position for building a unit from the connectable building components while exposing the storage area for access to the connectable building components or interlocking pieces.

Ritvik Toys Ltd. also sells a "Galaxy Blok Blaster" (Product No. 9501) building system shaped like a space ship and having three separable sections. The present inventor notes that one "Galaxy Blok Blaster" product indicates a patent pending molded in the bottom rocket blaster section of the system. The bottom rocket blaster section has a top surface with a baseplate including a plurality of upwardly extending cylindrical connectors for building a unit. A middle section of the system is fabricated from clear plastic for storage of the connectable building components and a top nose cone section of the system includes an open area with an inner fixed baseplate. Two opposed slidable doors provide access to the inner baseplate. When one or both of the slidable doors are open, a builder can build on or out of this baseplate in the top nose cone section. The open area has a circular diameter of approximately 4 inches and a height of approximately 3 inches which, of course, are limited by the sizing of each door.

In the past there has also been a storage structure fabricated from plastic that provides ten shelves with ten corresponding translucent plastic drawers. Each drawer has five compartments. This storage structure is manufactured by Contico Manufacturing Company. A similar storage structure provided by Zag Ltd. of Israel is fabricated from plastic and includes six shelves with six corresponding translucent plastic drawers having latches. A handle is provided on top of the Zag structure. Each of the Zag drawers is molded to be divided into three compartments, that can be further divided in different configurations with optional plastic dividers. The present inventor notes that the Zag Ltd. instruction manual indicates a patent pending for the design. While the immediate above two storage structures are not specifically made for connectable building components, Lego Systems, Inc. provides a storage case fabricated from red plastic having a handle and a hinged door for closing and opening the case. Gray plastic snap fasteners secure the door in the closed position. The interior of this Lego case has only one compartment. Also, Lego Systems, Inc. provides Product No. 8062 for the "Lego Technic" product with one drawer having a plurality of compartments and being removable from the storage case to provide access to a lower storage area with a plurality of compartments.

Therefore, while prior art products exist for storage and building of units from connectable building components on a baseplate, it would be desirable to have a portable system with a plurality of drawers that includes a baseplate having connectors, where the baseplate is movable to an extended position for building a unit connectable with the baseplate connectors, and a controlled baseplate movement storage position for transporting of the unit built on the baseplate.

This controlled baseplate movement in combination with the friction fit of the connectable building components with the other connectable building components and the connectors on the baseplate would allow transporting of the system without having to dismantle the unit from the baseplate or damage the unit due to inability to control its movement while being transported.

SUMMARY OF THE INVENTION

A system, adapted for use with connectable building components used to build a unit, includes a structure having an open area accessible from the front of the structure. A baseplate is moveable between a storage position in the open area and an extended position adapted for building the unit from the connectable building components. The baseplate includes a plurality of connectors for connecting the unit to the baseplate. Guide rails attached to the structure in the open area block upward movement of the baseplate when in the storage position. Also, the closure, when in the closed position, blocks movement of the baseplate out of the open area in the structure. The system further includes a plurality of drawers having compartments positioned in shelves of the structure. The drawers move between a retracted position adapted for storing and transporting the connectable building components and an extended position for access to the connectable building component for building or dismantling the unit. Advantageously, a method of use of the system is also disclosed.

BRIEF DESCRIPTION OF THE DRAWINGS

The objects, advantages and features of the invention will become more apparent by reference to the drawings which are appended hereto, wherein like numerals indicate like parts and wherein an illustrated embodiment of the invention is shown, of which:

FIG. 4 is a section view taken along lines 4—4 of FIG. 1;

FIG. 5 is a front elevational view of the preferred embodiment of the present invention, as shown FIG. 2, with the closure in the closed position;

FIG. 6 is an alternative embodiment of the present invention shown in an elevational section view with the closure, shown in broken view, in the horizontal position and the baseplate in the storage position; and FIG. 7 is a top view of the alternative embodiment of the present invention with the closure, shown in broken view as shown FIG. 6, and the system is also shown in broken view and the top of the structure partially broken away to better illustrate the baseplate controlled by one of the guide rails in the system.

DETAILED DESCRIPTION OF PREFERRED EMBODIMENT

Figure 1:
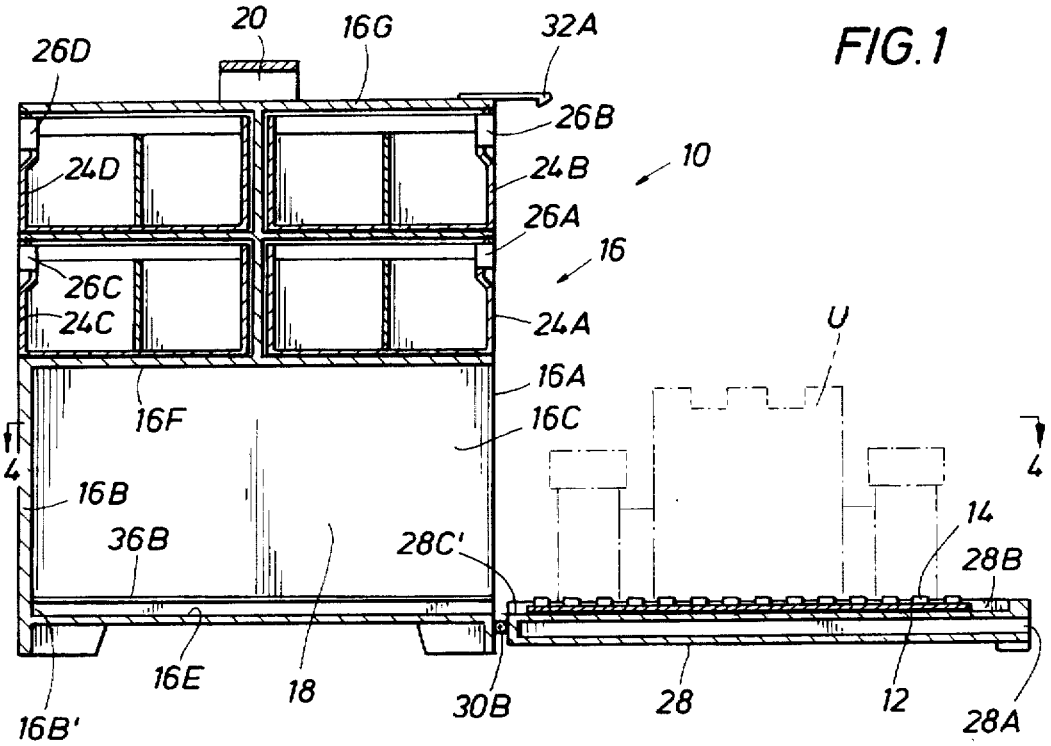
Fig. 1 is an elevational section view of the preferred embodiment of the present invention showing the closure in the horizontal position and the baseplate shown in the extended position on the top surface of the closure member and a unit built from connectable building components is shown in phantom view connected to the baseplate.

FIGS. 1–5 disclose the preferred embodiment of the system, generally indicated as 10. In the preferred embodiment, the baseplate 12 is rectangular shaped, as best shown in FIG. 4, and preferably has a dimension of 10 inches by 10 inches, providing a total coverage of 100 square inches. The number of upwardly extending cylindrical connectors, such as 14, and the baseplate 12, are not illustrated to scale, but are shown for illustration purposes only. Preferably, the conventional sizing and spacing of connectors on a baseplate would be as provided by Lego Systems, Inc. for baseplate Product No. 626 or Ritvik Toys Ltd. baseplate Product No. 9507.

Returning to FIG. 1, the system 10 preferably includes a monolithic structure, generally indicated as 16, having a front 16A, a back 16B, side 16C and side 16D, an inner bottom surface 16E and an inner top surface 16F that together define the open area 18, as best shown in FIGS. 1 and 4. The structure 16 preferably is fabricated from a polymer, similar to the Zag Ltd. storage structure, polymers such as polypropelene, polyethylene or other polymers could be used. Also, the polymer could be either a colored plastic, translucent plastic or a clear plastic, as discussed below. The structure 16 further includes a top 16G having a handle 20 that is centrally located to the system 10, so the system 10 remains horizontal when lifted by the handle 20 while being transported. It is also contemplated that the structure could be modular, similar to the Zag Ltd. storage structure.

Figure 2:
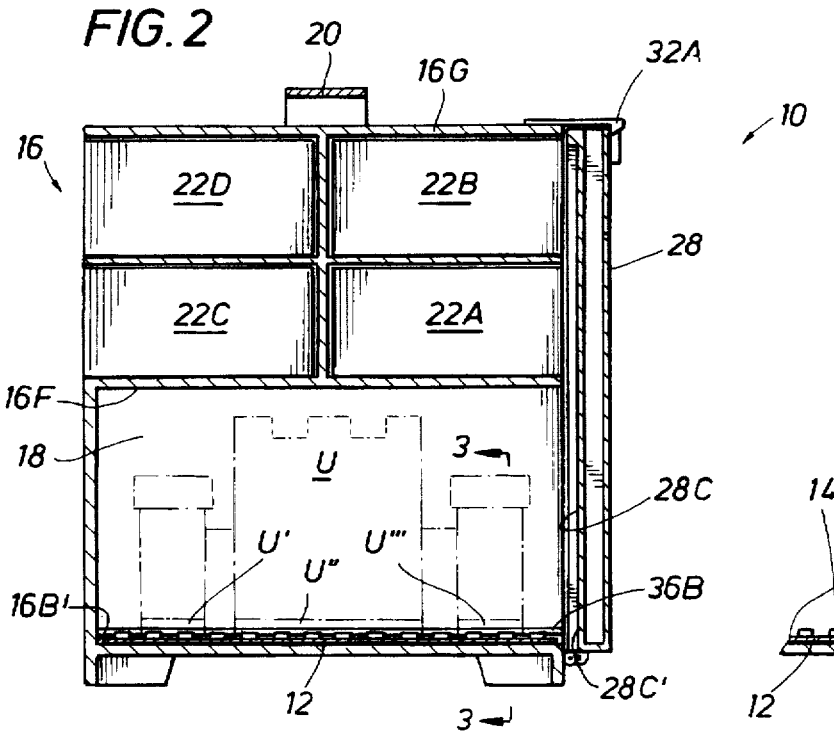
FIG. 2 is a view similar to FIG. 1 with the drawers in the shelves removed for clarity and the baseplate shown in the storage position and the closure in the closed position.
Figure 3:
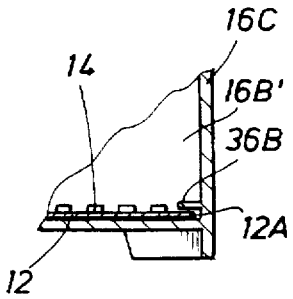
FIG. 3 is a partial section view taken along lines 3—3 of FIG. 2.

As best shown in FIG. 2, between the top 16G and the inner top surface 16F of the structure 16 are a plurality of shelves 22A, 22B, 22C, and 22D. Returning to FIG. 1, each of these shelves includes a corresponding drawer 24A, 24B, 24C, and 24D. Each of the drawers is preferably fabricated from a clear plastic to allow the builder to view the size, color and/or shape of the connectable building components or other accessory in the drawer without opening the drawer. Still referring to FIG. 1, each drawer preferably includes a corresponding latch 26A, 26B, 26C, and 26D for locking each respective drawer to the structure to prevent inadvertent opening of the drawers. Each drawer is further divided into a plurality of compartments that are moveable in the structure 16 between a retracted position (as shown in FIG. 1) for storing and transporting the connectable building components and an extended position, substantially the length of the drawer, or preferably completely withdrawable, for access to the connectable building components.

As can be seen in FIG. 1, when the drawers 24A and 24B are moved to their extended position, and the drawers 24C and 24D are moved to their extended position, drawers 24A and 24B are moved in an opposite direction from the drawers 24C and 24D. In other words, while drawers 24A and 24B are moved towards the closure 28, the drawers 24C and 24D are moved away from the closure 28. Preferably, the drawers 24A, 24B, 24C and 24D can be sized in a number of configurations with optional dividers to provide the desired sized compartments in each drawer. For example, the drawers could be divided to hold a certain quantity of connectable building components and accessories, such as, miniature figurines. Also, while the drawers preferably move along the front and back direction, the shelves and drawers could be fabricated in the structure 16 to move out of the side of the system 10. Also, fewer or additional shelves and corresponding drawers could be provided. The closure 28 is preferable fabricated from clear plastic and in the preferred embodiment includes a slot 28A for receiving documents, such as an idea book (Lego Product No. 697), building instructions, magazines, advertisements and other documents associated with the connectable building systems. The closure 28 includes a lip 28B around three of its sides for controlling movement of the baseplate 12 thereon. When the baseplate 12 is in the extended position on the top surface 28C of the closure 28, as shown in FIGS. 1 and 4, a builder can connect the building components on to the baseplate 12 and on the other building components to build a unit, such as unit U, shown in the shape a castle in FIGS. 1 and 2. The closure 28 is attached to the structure 16 by hinges 30A, 30B and 30C. While three hinges are illustrated in the preferred embodiment, any number of hinges could be used or a continuous hinge, such as a piano type hinge, could be used.

As best seen in FIGS. 1, 2 and 5, when the closure 28 is moved from the horizontal position (FIGS. 1 and 4) to the closed position (FIGS. 2 and 5), the slot end of the closure 28 urges the resilient fasteners 32A and 32B upwardly until the closure 28 is received past the hook on the fasteners 32A and 32B. The fasteners 32A and 32B provide the function of both holding the closure 28 in the closed position to close the open area 18, and limiting inadvertent movement of any documents, such as magazine 34, as best seen in FIG. 5. If the document 34 is sized so as to be less than the height of the closure 28, a number of oblong shaped openings 28D, 28E, and 28F are provided so that the document 34 can be pushed upwardly until it can be engaged in the area of 28G. The preferable clear plastic cover 28 allows a builder to view the documents therein without removal and, if the documents are removed, it allows the builder and others to view the unit U, such as shown in FIG. 2, particularly through the openings 28D, 28E and 28F.

Turning now to FIGS. 1, 2, 3 and 4, the guide rails 36A and 36B of the preferred embodiment are illustrated. The guide rails 36A and 36B are preferably integral with the structure 16 and are spaced apart from the inner bottom surface 16E a sufficient distance so as to allow the baseplate 12 to slide therebetween. Baseplate side edges 12A and 12B preferably will be free of connectors 14, preferably upwardly extending connectors, so that only the flat edges 12A and 12B are received between each rail 36A and 36B and the inner bottom surface 16E. As can be best seen in FIGS. 2 and 3, when the baseplate 12 with the unit U thereon is moved to the storage position, the baseplate edges 12A and 12B are between the guide rails 36A and 36B, respectively, and the inner bottom surface 16E. Furthermore, the edge 12C of the baseplate 12 is blocked by the surface 16B' of the back 16B of the structure 16 and the front edge 12D of the baseplate 12 is blocked by the blocking member 28C' of the top surface 28C of the closure 28, when the closure 28 is in the closed position. Therefore, when the closure 28 is in the closed position for transporting the system 10, the movement of the baseplate 12 is controlled. This control of the baseplate 12 in combination with the friction fit of the connectable building components, such as U', U" and U'", as best shown in FIG. 2, further provides controlled movement of the unit U in the system 10. The use of the handle 20 assist in transporting the baseplate 12 in the horizontal position.

ALTERNATIVE EMBODIMENT

Turning now to FIGS. 6 and 7, the alternative embodiment includes similar components as the preferred embodiment, such as a monolithic structure, generally indicated at 40, having an open area 42 defined by the inner bottom surface 40A, inner top surface 40B, back 40C, side 40D and side 40E. Above the inner top surface 40B, are shelves 44A, 44B and 44C to receive drawers, similar to drawers 24A, 24B, 24C and 24D of the preferred embodiment. Preferably each of these drawers would include respective latches. The top 40F of the structure 40 includes a handle 46 centrally located for horizontal positioning of the baseplate 52 while transporting the system 10'. The back 40C of the structure 40 includes a spaced apart wall 48 to define a slot 48A therebetween for receiving documents, similar to the slot 28A of closure 28. However, while slot 48A is fixed, preferably the concept of the oblong openings and the engagement area, such as shown in FIG. 5, is used for slot 48A of the alternative embodiment.

In the alternative embodiment, the closure 50 would preferably extend the height of the structure 40. However, if desired, the closure 50, like the closure 28, could be sized to only cover the open area 42 or would even only have a height sufficient, when in the closed position, to provide a blocking member, such as blocking member 50'. Since the system 10' height is greater than its depth, as compared to the preferred embodiment, the closure 50 could include an expanded top surface 50A having a plurality of connectors. As illustrated, the connectors are preferably a plurality of upwardly extending cylindrical connectors 50B for connection with the connectable building components or interlocking pieces. The closure 50 includes a lip 50C extending on three sides to receive the baseplate 52. The baseplate 52 is movable from the storage position, as shown in FIGS. 5 and 6, to the extended position received on the closure 50 within the lip 50C. Therefore, built units, such as a unit U, as shown in FIGS. 1 and 2, could be moved from the baseplate 52 to the expanded top surface 50A, so that the total building surface would include both the baseplate 52 and the top surface 50A. Similar to the preferred embodiment, fasteners 54A and 54B are used to hold the closure in the closed position. Also the system 10' includes guide rails 56A and 56B that in combination with the back surface 40C', of the structure 40, and blocking member 50' of the closure 50, control movement of the baseplate 52 and any unit placed thereon, as previously discussed above.

METHOD OF USE

Referring to the preferred embodiment of FIGS. 1–5, a builder can transport the system 10, as shown in FIG. 2, with the closure 28 in the closed position and the baseplate 12 in the storage position. The latching members 26A, 26B, and particularly latches 26C and 26D, prevent inadvertent opening or extension of the drawers from their shelves when being transported. Latches 26A and 26B are therefore redundant when the closure 28 extends the height of the system 10. However, if the closure 28 only covered the open area below shelf 22A or only a height sufficient to provide the blocking member 28C', the latches 26A and 26B are required to prevent inadvertent opening of the drawers. The baseplate 12, could at the time of the transport, include a fully built unit, a partially built unit, or no unit and each of the drawers 24A, 24B, 24C and 24D could include a variety of connectable building components and other related accessories. The overall size of the system 10 could also be configured so as to allow positioning of the system 10 within the overhead carrier of a commercial airline, but the height from the inner bottom surface 16E to the inner top surface 16F is at least 4 inches and preferably in the range of 6 to 8 inches. The width would be as such to accommodate with the preferred baseplate 12, as discussed above. During the storage and transport mode, as shown in FIG. 2, the movement of the baseplate 12 and the unit U thereon are controlled, as previously discussed. However, the closure 28 could be partially opened to gain access to any documents in the slot 28 for review by a builder and to allow viewing of the unit U through the clear closure 28, as discussed. It is also contemplated that the structure 16 around the sides and back of the open area can be fabricated from clear plastic to allow viewing from all angles, so as to provide a showcase for the unit U.

When desired, the closure 28 can be moved to the horizontal position, as shown in FIGS. 1 and 4, by upward movement of the fasteners 32A and 32B. The baseplate 12 can then be extended onto the closure 28 within the lip 28B. A builder then can select desired connectable building components from the drawers 24A, 24B, 24C and/or 24D to continue building onto the unit U or to disassemble portions or all of the unit for rebuilding and reconfiguration. As discussed, the drawers are preferably capable of being completely withdrawn from the structure. When desired, the baseplate 12 can then be moved to the storage position and the closure 28 again moved to the closed position to control movement of the baseplate and the unit thereon.

Turning to FIGS. 6 and 7, the method of use for the system 10' is similar, however, as can be seen, the documents can be retrieved from slot 48A without movement of the closure 50. Also, upon horizontal positioning of the closure 50, the baseplate 52 can be extended to be received and positioned within lip 50C. A unit, similar to the unit U, shown in FIGS. 1 and 2, can remain on the baseplate 52 though other units on the baseplate 52 could be moved to the extended building surface 50A or other connectable building components taken from the drawers in shelves 44A, 44B and 44C for further assembly or disassembly of units.

The foregoing disclosure and description of the invention are illustrative and explanatory thereof, and various changes in the size, shape and materials, as well as the details of the illustrated construction may be made without departing from the spirit of the invention.

I claim:

1. A system comprising:

a structure having a front, a back, and an inner horizontal bottom surface, an open area in said structure defined by said front, said back and said inner horizontal bottom surface, a baseplate having a plurality of connectors, said baseplate moveable between a horizontal storage position in said open area and an extended position, a unit including a plurality of connectable building components, wherein a portion of the building components are connected with said connectors to position the unit on said baseplate, a guide rail extending into said open area and above said inner bottom surface for blocking upward movement of said baseplate when said baseplate is in said horizontal storage position ad for guiding the movement of said baseplate in a plane substantiallyparallel to said inner horizontal bottom surface, and a blocking member movable between a closed position substantially perpendicular to the baseplate in the horizontal storage position for blocking outward movement of said baseplate and a horizontal position for receiving said baseplate when said baseplate is in the extended position.

2. System of claim 1 further comprising, a handle attached to said structure to maintain said baseplate substantially horizontal when the system is lifted by said handle.

3. System of claim 1 further comprising, a first drawer movably positioned in said structure between a retracted position adapted for storing the connectable building components and an extended position for access to the connectable building components.

4. System of claim 3 further comprising a second drawer movably positioned in said structure between a retracted position and an extended position, whereby when said first and second drawers are moved to the extended positions they are moved in opposite directions.

5. System of claim 1 wherein said blocking member comprises a closure moveable to a closed position for closing said open area of said structure, whereby said guide rail and said closure control movement of said baseplate.

6. System of claim 5 wherein said closure is fabricated from clear plastic.

7. System of claim 1 wherein said blocking member including a top surface when in a horizontal position, said top surface adapted for receiving said baseplate when said baseplate is in its extended position.

8. System of claim 7 wherein said top surface includes a plurality of connectors.

9. System of claim 8 wherein said connectors are a plurality of upwardly extending cylinders.

10. System of claim 1 wherein said unit is storable in said open area when said baseplate is in the storage position.

11. System adapted for use with connectable building components: comprising:

a structure having a front, a back and an inner horizontal bottom surface, an open area accessible from said front of said structure, a baseplate having a plurality of upwardly extending cylinders and said baseplate movable in a plane substantially parallel to said inner horizontal bottom surface between a horizontal storage position in said open area and an extended position, a blocking member movable between a blocking position substantially perpendicular to the baseplate in the horizontal storage position in said front of said structure for blocking movement of said baseplate from said horizontal storage position and a horizontal position for receiving said baseplate when said baseplate is in its extended position, and a drawer movably positioned in said structure between a retracted position and an extended position.

12. System of claim 11 further comprising a guide rail for controlling upward movement of said baseplate and guiding movement of said bas,plate in the plane substantially parallel to said inner horizontal bottom surface.

13. System of claim 12 wherein said blocking member comprises a closure moveable to a closed position for closing said open area of said structure, whereby said guide rail, and said closure control movement of said baseplate.

14. System of claim 13 wherein said closure positions said baseplate adjacent to a plurality of connectors on said closure.

15. System of claim 14 wherein said plurality of connectors on said closure are a plurality of upwardly extending cylinders.

16. System of claim 11 wherein said connectors are a plurality of upwardly extending cylinders.

17. System adapted for use with connectable building components, comprising:

a structure having a front, a back and an inner horizontal bottom surface, an open area accessible from said front of said structure, a baseplate movable between a horizontal storage position in said open area and an extended position, said baseplate including a plurality of upwardly extending cylinders, a guide rail for blocking upward movement of said baseplate when said baseplate is in said horizontal storage position and for guiding movement of said baseplate in a plane substantially parallel to said inner horizontal bottom surface, and a blocking member movable between a closed position substantially perpendicular to the baseplate in the horizontal storage position for blocking outward movement of said baseplate and a horizontal position for receiving said baseplate when the baseplate is in the extended position.

18. System of claim 17 further comprising a second guide rail for blocking upward movement of said baseplate whereby said guide rails and said blocking member control movement of said baseplate when the system is lifted.

19. System of claim 17 further comprising a handle attached to said structure to maintain the baseplate substantially horizontal when said baseplate is in said horizontal storage position and the system is lifted by said handle.

* * * * *